US005784478A

United States Patent [19]

Untersander

[11] Patent Number: 5,784,478

[45] Date of Patent: *Jul. 21, 1998

[54] AUDIBLE ENVIRONMENT AWARENESS RESTORING DEVICE

[75] Inventor: Peter Untersander, Ecoteaux, Switzerland

[73] Assignee: Stanton Magnetics, Inc., Plainview, N.Y.

[ * ] Notice: The term of this patent shall not extend beyond the expiration date of Pat. No. 5,687,244.

[21] Appl. No.: 819,739

[22] Filed: Mar. 18, 1997

Related U.S. Application Data

[63] Continuation-in-part of Ser. No. 621,711, Mar. 28, 1996.

[51] Int. Cl.[6] ..... H04R 25/00

[52] U.S. Cl. ..... 381/151; 381/68.3

[58] Field of Search ..... 381/68, 68.3, 68.2, 381/68.4, 151, 183, 187, 23.1, 205; 600/25; 607/56, 57

[56] References Cited

U.S. PATENT DOCUMENTS 2,482,044 9/1949 Vernier ..... 381/151

4,685,488 8/1987 Shames et al. ..... 381/151

5,086,464 2/1992 Groppe ..... 381/68

FOREIGN PATENT DOCUMENTS 0009116 4/1980 European Pat. Off. ..... 381/68.3

*Primary Examiner*—Huyen Le

*Attorney, Agent, or Firm*—Kane.Dalsimer.Sullivan, Kurucz.Levy.Eisele and Richard, LLP

[57] ABSTRACT

An audible environment awareness restoring device allows a person to perceive, through his sense of touch, audible sounds corresponding to the human voice. A bone conduction speaker or transducer is mounted against a person's body, preferably against the sternum. An audio signal from one or more microphones is fed to the bone conduction speaker or transducer which converts the audio signal to vibrations. The bone conduction speaker or transducer transmits the vibrations to the person's rib-cage which will then resonate in synchronism with the input audio signal.

13 Claims, 7 Drawing Sheets

AUDIBLE ENVIRONMENT AWARENESS RESTORING DEVICE

CROSS-REFERENCE TO RELATED APPLICATIONS

This is a continuation-in-part (CIP) of U.S. patent application Ser. No. 08/621,711 filed on Mar. 28, 1996.

BACKGROUND OF THE INVENTION

1. Field of the Invention

This invention pertains to an audible environment awareness restoring device and, more particularly, to a system having one or more microphones and a bone conduction speaker or transducer for converting audio electrical signals into vibrations which are transmitted into a person's body to allow a person to feel audible sounds which correspond to the human voice.

2. Description of the Prior Art

Audible sounds are generally perceived by a person's sense of hearing but can also be perceived by a person's sense of touch depending on the environment. A person will always sense the audible sounds through his sense of hearing unless he is deaf. If the audible sounds are loud enough, a person's body will feel the amplified audible sounds or music in his body through his sense of touch.

Sound transducers have been used as bone conduction speakers to induce vibrations in a person's body from an electrical audio signal such as in U.S. patent application Ser. No. 08/621,711 for "Bone Conduction Speaker and Mounting System." These transducers or bone conduction speakers will allow a profoundly deaf person to feel audible sounds through his sense of touch.

A child typically learns to speak by attempting to imitate the sound, intonation and annunciation of an adult voice by comparing the sound, intonation and annunciation of his own voice with that of the adult. Through this method of imitation through comparative feedback, a child learns to speak. A profoundly deaf person, because he can hear neither the sound of his own voice nor the sound of another's voice, cannot learn to speak by this method of imitation through comparative feedback. Rather, a profoundly deaf person typically learns to speak by attempting to imitate the physical movements of another's mouth, which does not provide any clues as to sound, intonation and annunciation.

Therefore, in order to alleviate these problems, an objective of the present invention is to provide an audible environment awareness restoring device which will allow a profoundly deaf person to feel the audible sounds of his environment and of his own voice.

Another object of the present invention is to provide an audible environment awareness restoring device which will assist a profoundly deaf person in learning to speak by the method of imitation through comparative feedback.

SUMMARY OF THE INVENTION

The above and other beneficial objects are obtained in accordance with the present invention by providing an audible environment awareness restoring device which can be used to allow a profoundly deaf person to perceive audible sounds, including the sounds of his own voice and the voices of others, through his sense of touch. A transducer is mounted against a person's body, preferably against the sternum. An audio signal from one or more microphones is fed to the transducer which converts the audio signal to vibrations. The transducer transmits the vibrations to the person's rib-cage which will then resonate in synchronism with the input audio signal. By attempting to duplicate the vibrations felt, preferably while mimicking the physical movements of a speaker's mouth, the profoundly deaf person may be taught to more accurately duplicate the speech of the speaker.

DETAILED DESCRIPTION OF THE PREFERRED EMBODIMENTS

The aforementioned figures illustrate an audible environment awareness restoring device 10 where identical numerals in each figure represent identical elements.

Figure 1:
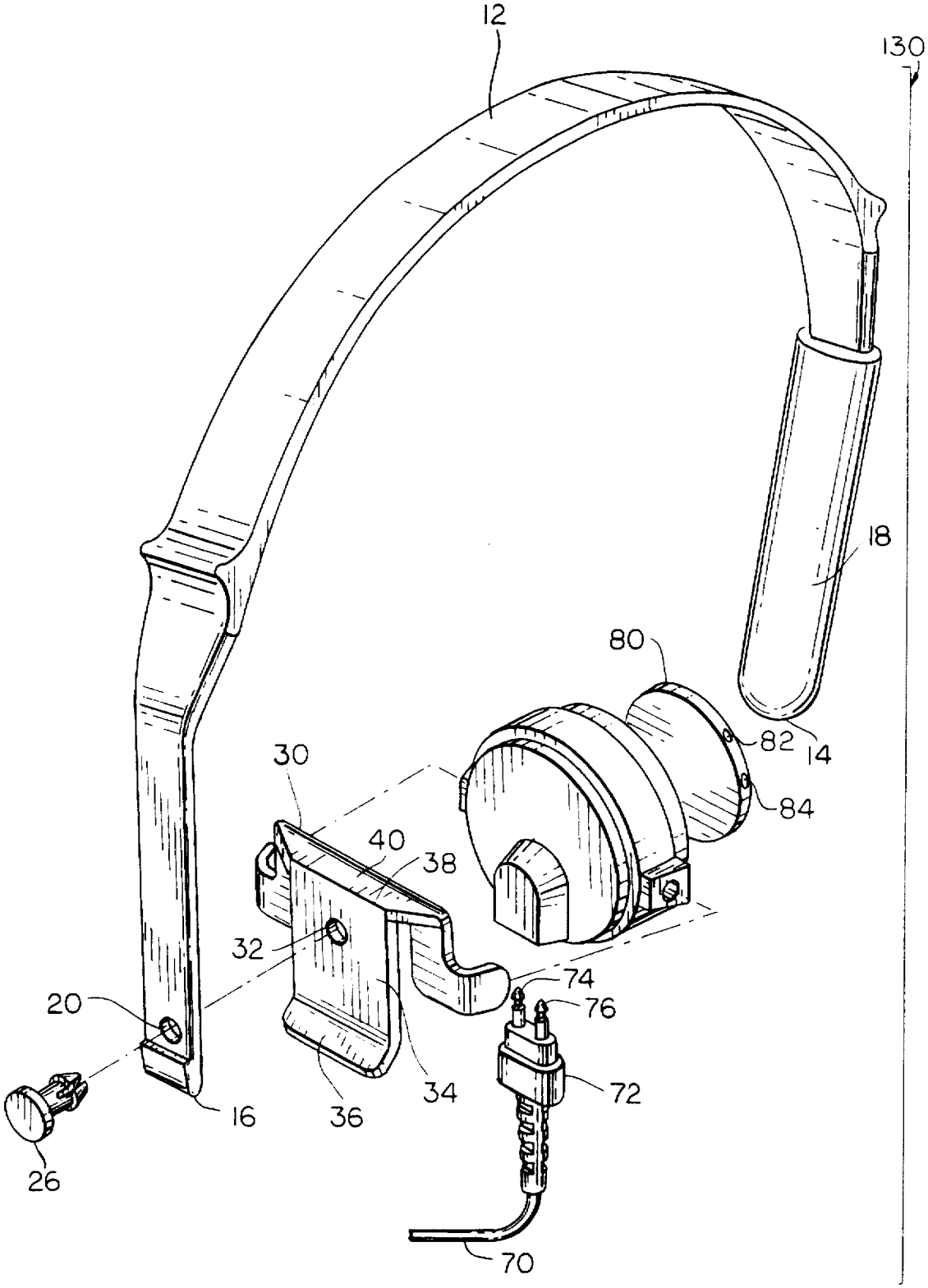
FIG. 1 is an exploded view of a bone conduction speaker and mounting means of an audible environment awareness restoring device.
Figure 2A:
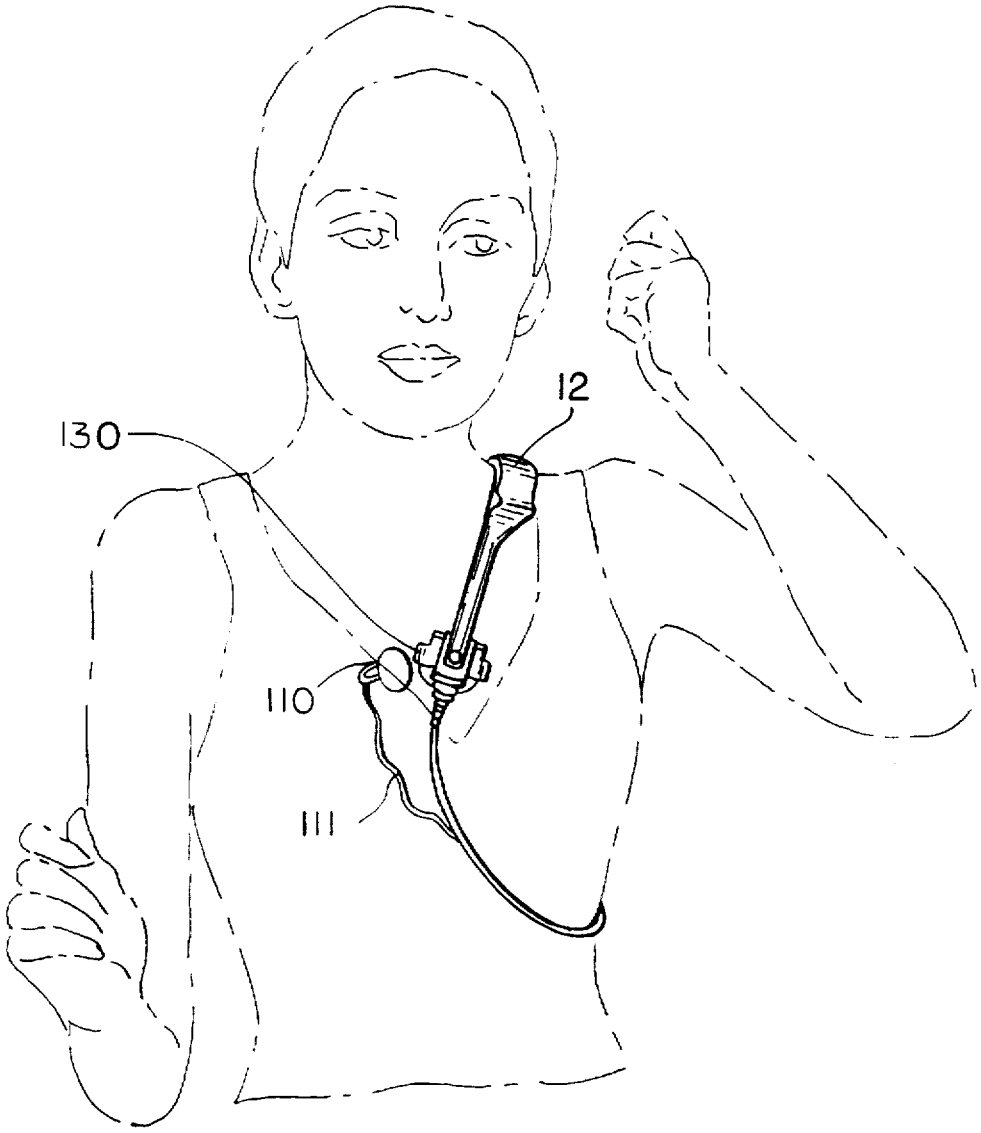
FIG. 2*a* is a representative view depicting how an audible environment awareness restoring device in accordance with the invention is positioned on a person.
Figure 2B:
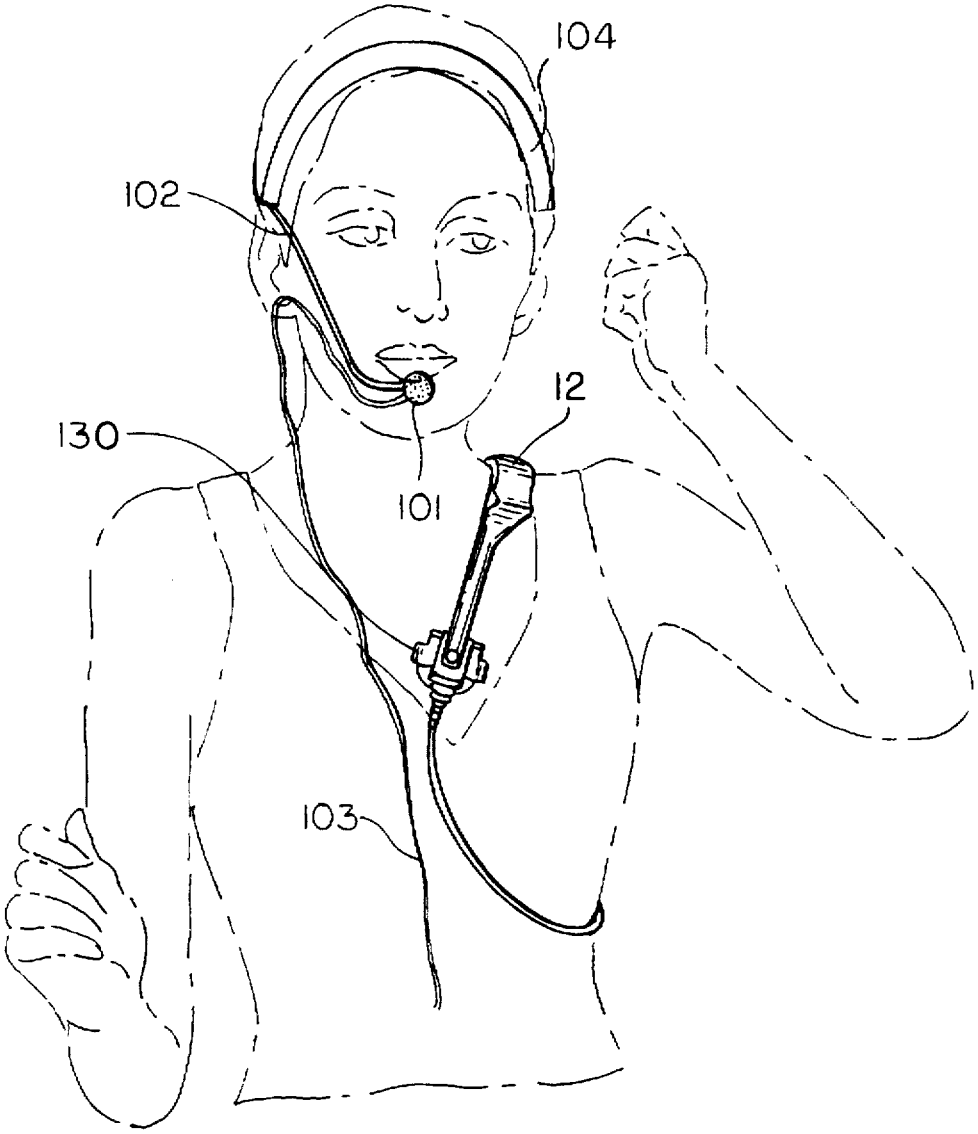
FIG. 2*b* is a view similar to FIG. 2*a* depicting how another embodiment of the audible environment awareness restoring device may be positioned on a person.
Figure 2C:
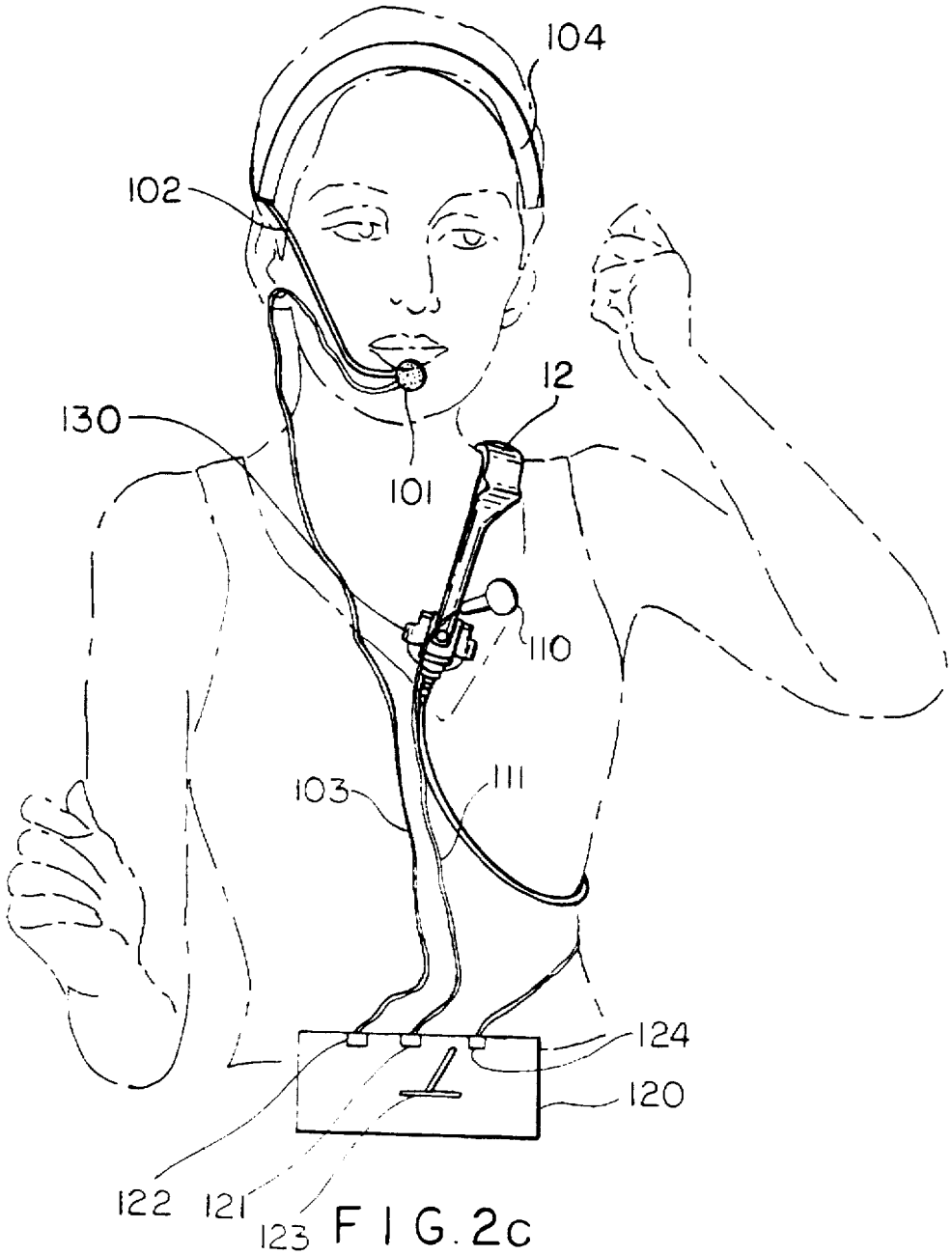
FIG. 2*c* is a view similar to FIG. 2*a* depicting how yet another embodiment of the audible environment awareness restoring device may be positioned on a person.

As illustrated in FIG. 1, the bone conduction speaker and mounting means 130 includes a band 12 which has an end 14 and an end 16. Band 12 can be made of any material that is flexible enough to allow band 12 to fit over a person's shoulder as shown in FIGS. 2*a*–2*c*. Padding 18 covers end 14 of band 12. Padding 18 should provide a non-slip surface, which will prevent band 12 from moving, and, thus, can be made of many materials such as neoprene tubing.

Band 12 is connected to clip 30 at end 16. End 16 has a hole 20. Clip 30 has a hole 32 located in the center of back 34. When holes 20 and 32 are lined up, plug 26 is inserted through holes 20 and 32 and, thus, connects band 12 to clip 30. Plug 26 can be of any design to allow clip 30 to rotate around plug 26 when plug 26 has been inserted through holes 20 and 32. Plug 26 allows the bone conduction speaker 80 to have one axis of rotation.

Figure 2D:
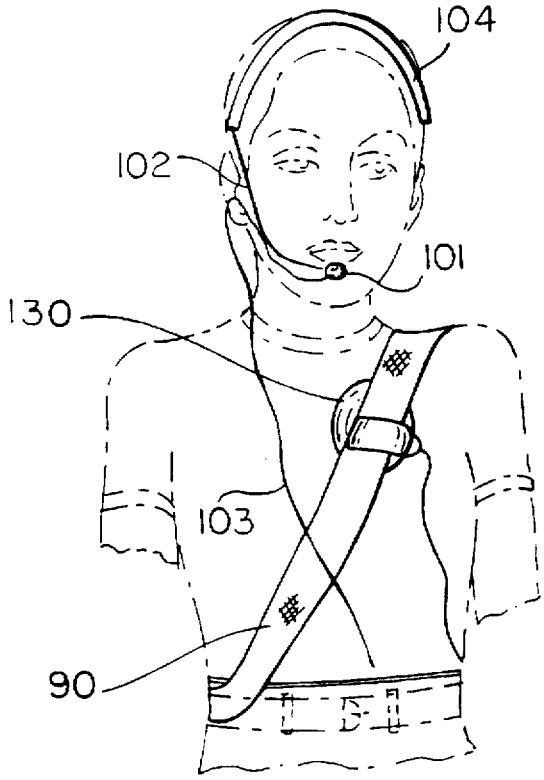
FIG. 2*d* is a view similar to FIG. 2*a* depicting how still another embodiment of the audible environment awareness restoring device may be positioned on a person.
Figure 3:
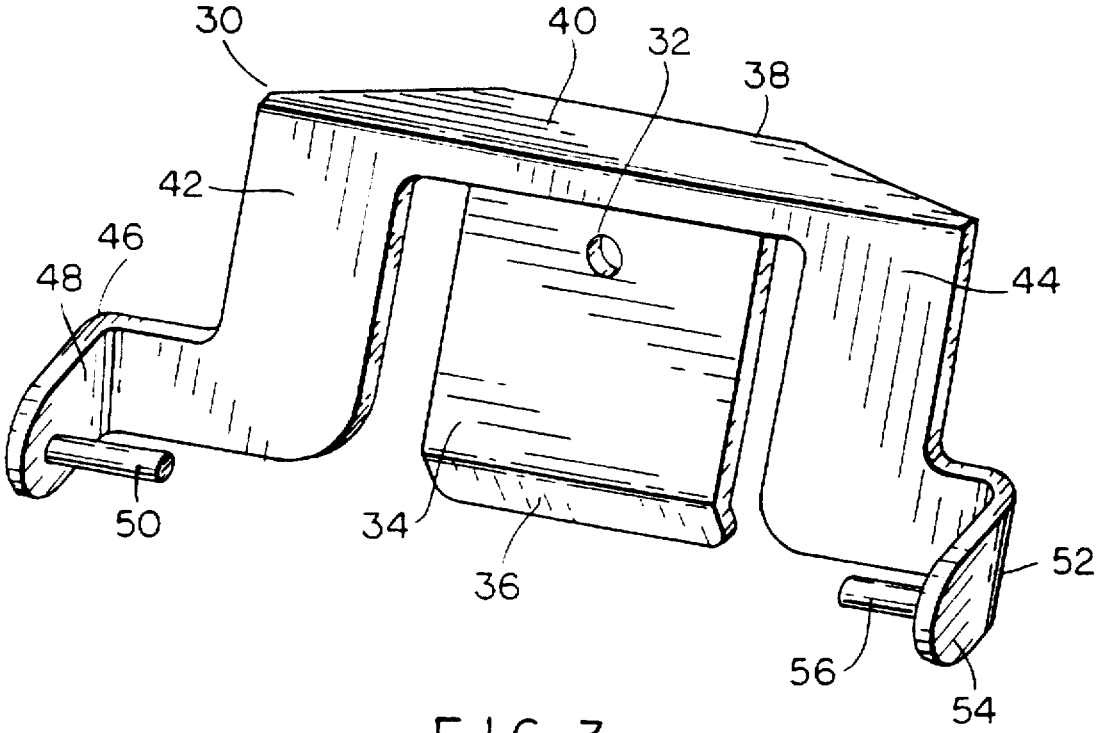
FIG. 3 is a front perspective view of the clip of an audible environment awareness restoring device.
Figure 4:
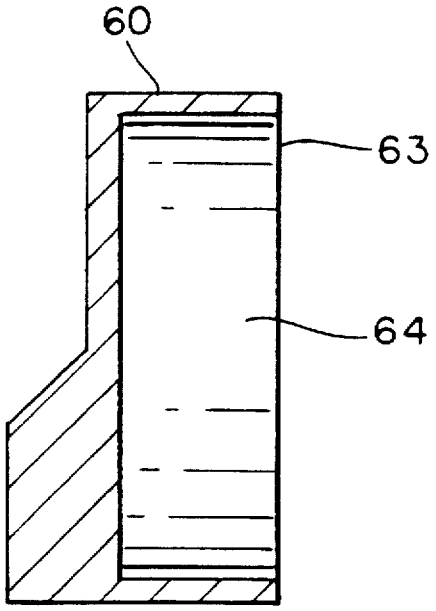
FIG. 4 is a side elevational view of the retaining ring of an audible environment awareness restoring device.
Figure 5:
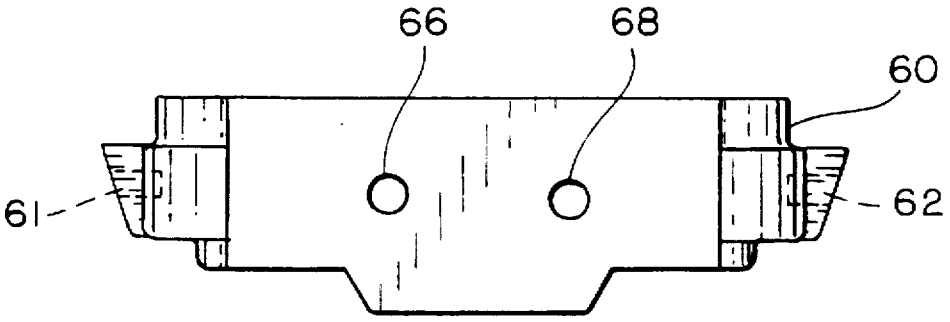
FIG. 5 is a bottom plan view of the retaining ring shown in FIG. 4.

In addition to being able to be mounted on band 12, clip 30 is shaped to be able to mount on belt 90 as shown in FIG. 2*d*. Belt 90 should be flexible and can be made out of an elastic woven material. Belt 90 can be constructed in a number of ways. Belt 90 can be adjustable or can be one size but belt 90 should be large enough to go over a person's shoulder and across a person's sternum. In addition, belt 90 can be connected to a number of places on either side of the person. For example, belt 90 can be constructed to connect to the waist of a person's pants or to a person's belt.

Clip 30 has a back 34 and a front left arm 42 and front right arm 44 which are designed to slip over opposite sides of belt 90. The bottom end 36 of back 34 slopes away from back 34 to allow clip 30 to easily slip over one side of belt 90. The top end 38 of back 34 is connected to top surface 40. Top surface 40 perpendicularly extends away from back 34 in a direction opposite to the direction in which bottom end 34 slopes away from back 34. In addition, top surface 40 extends beyond the left and right sides of back 34 to front left arm 42 and to front right arm 44. Front left arm 42 and front right arm 44 extend downwards from top surface 40 and parallel to back 34. Front left arm 42 and front right arm 44 are designed to slip over the side of belt 90 opposite the side over which back 34 slips.

Clip 30 holds retaining ring 60 by means of pivot rods 50, 56. Front left arm 42 is L shaped where the bottom portion of the L extends away from back 34 to side 46. Tab 48 perpendicularly extends away from side 46 in a direction opposite to the direction in which bottom end 34 slopes away from back 34. Pivot rod 50 perpendicularly extends inward from the center of tab 48 toward the center of clip 30. Front left arm 44 is also L shaped where the bottom portion of the L extends away from back 34 to side 52. Tab 54 perpendicularly extends away from side 52 in a direction opposite to the direction in which bottom end 34 slopes away from back 34. Pivot rod 56 perpendicularly extends inward from the center of tab 54 toward the center of clip 30. Clip 30 is made of a flexible material to allow pivot rods 50, 56 to slip around the sides of retaining ring 60 and into holes 61, 62 respectively. Pivot rods 50, 56 allow bone conduction speaker 80 to have a second axis of rotation.

Retaining ring 60 is designed to hold bone conduction speaker 80. Retaining ring 60 has a front face 63 which has a recess 64. Bone conduction speaker 80 slips into recess 64. Bone conduction speaker 80 has two holes 82, 84 which respectively line up with holes 66, 68 in retaining ring 60. Cable 70 has plug 72 which has two prongs 74, 76. Prongs 74, 76 slip through holes 66, 68 of retaining ring 60 and into holes 82, 84 of bone conduction speaker 80 and, thus, hold bone conduction speaker 80 in retaining ring 60. Plug 72 is preferably an IEC90 polarized 90-degree plug. Cable 70 runs from plug 72 to the electronics which provide the input audio signal that drives bone conduction speaker 80.

Bone conduction speaker 80 basically operates by causing a person's bones to vibrate in synchronism with an audio signal. Bone conduction speaker 80 is a transducer that converts an input audio signal into vibrations that are felt by a person's body. When bone conduction speaker 80 is driven hard enough, the vibrations from bone conduction speaker 80 will cause a person's bones to vibrate allowing the person to feel the audible sounds being transmitted by the audio signal. A person can generally feel audible sounds in a certain frequency range. Even though experts will debate what the exact upper and lower limits of this frequency range are, a person's body is capable of feeling audible sounds in a frequency range of about 4 Hz to 1000 Hz. Thus, the bone conduction speaker 80 should be a transducer that will have a response in this frequency range.

The transducer of bone conduction speaker 80 should preferably be a miniaturized inertial transducer with a response of 250 Hz to 7,000 Hz which comfortably spans the range of audible sounds which can be felt by a person's body. In addition, depending on the construction of the transducer and the electronics that drives the transducer, the upper or lower limits of the range may be adjusted to maximize the effect or to better use the power supply driving the electronics which provides the audio input signal. The transducer response, however, should be as large as possible and the input audio signal should not be filtered in order to allow a person's body to feel a wider range of vibrations and, thus, wider range of audible sounds from bone conduction speaker 80.

The positioning of bone conduction speaker 80 on a person's body can also affect how the body feels the vibrations created by the bone conduction speaker 80. Bone conduction speaker 80 can be placed anywhere on a person's body. The vibrations transmitted by bone conduction speaker 80 into a person's body will be better felt if bone conduction speaker 80 is held against the sternum of a person's chest. A person's rib cage is the most elastic structure of the human skeleton and, therefore, will vibrate in synchronism with the vibrations of bone conduction speaker 80 better than any other part of the body.

FIGS. 2*a*, 2*b*, 2*c* and 2*d* illustrate how bone conduction speaker and mounting means 130 can be used to position bone conduction speaker 80 against a person's sternum. If band 12 is used, band 12 is slipped over a person's shoulder as shown in FIGS. 2*a*, 2*b* and 2*c*. If belt 90 is used, belt 90 is placed over a person's shoulder as shown in FIG. 2*d*. In both cases, bone conduction speaker 80 is positioned against the sternum. When an audio signal is fed to bone conduction speaker 80, bone conduction speaker 80 will vibrate in synchronism with the audio signal and will cause the person's rib cage to resonate. The vibrations of the bone conduction speaker 80 are transmitted directly to the sternum and rib cage and are not dampened by human tissue as would happen if bone conduction speaker 80 was placed on a person's stomach or neck.

The present invention holds bone conduction speaker 80 against the sternum with a definite pressure but also allows bone conduction speaker 80 to adjust to the surface variations of the sternums of different people. Both band 12 and belt 90 allow the bone conduction speaker 80 to move back and forth from the person's sternum while, as previously mentioned, plug 26 and pivot rods 50, 56 allow the bone conduction speaker 80 to rotate in two different directions. Thus, both band 12 and belt 90 in conjunction with clip 30 will hold the bone conduction speaker 80 against a person's body with a definite pressure, will help to dampen any extraneous vibrations created by movement of the person or of the connecting cable and will help bone conduction speaker 80 to lie flat against said person's sternum. The vibrations from bone conduction speaker 80 can then be transmitted directly to the person's rib cage allowing a person, who is listening to an audio signal, to also feel the audio signal or allowing a person, who is deaf, to now be able to feel the audible sounds analogous to if he were actually hearing the audible sounds.

One embodiment of the audible environment awareness restoring device 10 includes an omnidirectional microphone 110. Omnidirectional microphone 110 includes a clip for attaching omnidirectional microphone 110 a person's clothing. Omnidirectional microphone 110 should be positioned preferably over the person's collarbone as shown in FIG. 2*a* so that it receives the ambient audible sounds surrounding the person and reduces the possibility of feedback from the bone conduction speaker 80. Omnidirectional microphone 110 converts the ambient sounds into an electrical audio input signal, which is transmitted to the bone conduction speaker 80 through cable 70. A profoundly deaf person can use this embodiment of the present invention to gain an awareness of his audible environment, which he cannot hear.

Another embodiment of the present invention includes a microphone boom assembly 100. The microphone boom assembly 100 includes a headband 104 and a unidirectional microphone 101 mounted on a boom 102. The headband 104 can be made of any material that is flexible enough to allow the headband 104 to fit around a person's head as shown in FIGS. 2*b* and 2*d*. Boom 102 extends from headband 104. Boom 102 can be made of any material that is flexible enough to allow the unidirectional microphone 101 to be positioned in close proximity to a person's mouth as shown in FIGS. 2*b*–2*d*. The unidirectional microphone 101 converts the sound of the person's own voice into an electrical audio signal which is transmitted through wire 103 and cable 70 to the bone conduction speaker 80. Thus, a profoundly deaf person can use this embodiment to gain an awareness of the sound of his own voice, which he cannot hear, by "feeling" the vibrations resulting from his speech.

Yet another embodiment of the present invention includes both an omnidirectional microphone 110 and a microphone boom assembly 100. The omnidirectional microphone 110 is preferably positioned over a person's collarbone so that it receives the ambient audible sounds surrounding the person and reduces the possibility of receiving feedback from bone conduction speaker 80. Omnidirectional microphone 110 converts the ambient sounds into an electrical audio signal, which is transmitted to the bone conduction speaker 80 through wire 111 and cable 70. The unidirectional microphone 101 is mounted on boom 102 of boom assembly 100 and positioned in close proximity of the person's mouth. The unidirectional microphone 101 converts the sound of the person's own voice into an electronic audio signal which is also transmitted to the bone conduction speaker 80 through wire 103 and cable 70. A profoundly deaf person can use this embodiment of the present invention to simultaneously gain an awareness of his audible environment, which he cannot hear, and of the sound of his own voice, which he also cannot hear. Because a profoundly deaf person using this embodiment of the present device can gain an awareness of both his audible environment and the sound of his own voice, the profoundly deaf person can use this embodiment of the present invention to assist in learning to speak by the method of imitation through comparative feedback. That is, the profoundly deaf person would try to emulate with his own voice the sensations that he perceived as a result of another's voice. By imitating both the physical movements of a speaker's mouth and the sensations perceived as a result of the speaker's voice, the effectiveness of the audible environment restoring device for assisting a profoundly deaf person to learn to speak is further enhanced.

Figure 6:
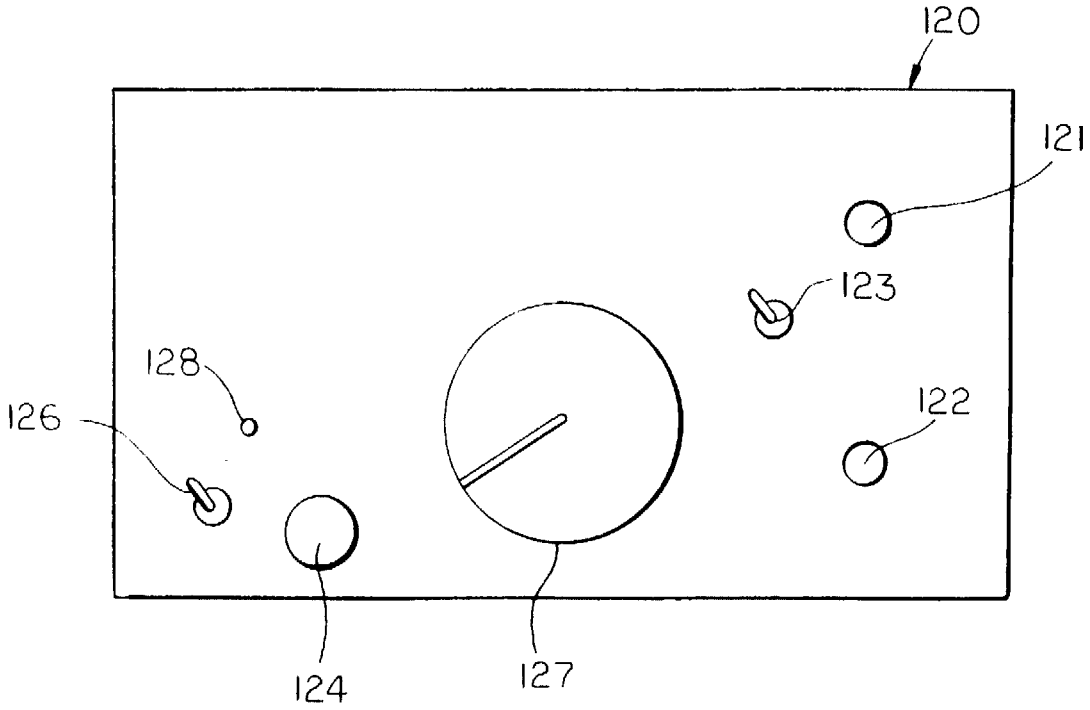
FIG. 6 is a top plan view of the interface unit of an audible environment awareness restoring device.

Yet another embodiment of the present invention further includes an interface unit 120 as shown in FIG. 2*c*. As shown in FIG. 6, the interface unit 120 includes a high-sensitivity electrical audio signal input 121, line-level electrical audio signal input 122, electrical audio signal output 124, input source switch 123, power switch 126, power indicator LED 128 and volume control 127. High-sensitivity electrical audio input 121 provides phantom voltage to omnidirectional microphone 110, which is of a type requiring phantom voltage to generate an electrical audio signal. Omnidirectional microphone 110 is sufficiently sensitive to generate an electrical audio signal corresponding both to the audible environment of a person and to a person's own voice. Omnidirectional microphone 110 transmits the electrical audio signal through wire 111 to high-sensitivity electrical audio signal input 121 of interface unit 120. Line-level electrical audio signal input 122 can receive an electrical audio signal from any secondary audio source. Input source switch 123 selectively transmits one of the electrical audio signals through electrical audio signal output 124 to bone conduction speaker 80 through cable 70. A profoundly deaf person using this embodiment of the present invention can selectively switch between the omnidirectional microphone 110 and the secondary audio source, thereby selecting between feeling the sound of his audible environment, which includes his own voice, and feeling the sound of the secondary audio source.

This embodiment of the present invention has the benefit of reducing or eliminating potential confusion as to the source of the perceived sounds by selectively transmitting to the bone conduction speaker 80 only one of the electrical audio signals generated by the omnidirectional microphone 110 and the secondary audio source. When used in a face-to-face teaching environment between a teacher and a profoundly deaf student, omnidirectional microphone 110 generates an electrical audio signal corresponding both to the teacher's voice and to the profoundly deaf student's voice.

When used in a classroom environment with one teacher and many profoundly deaf students, a teacher's microphone may be connected to the line-level electrical audio signal input 122 of the audible environment restoring device worn by each profoundly deaf student. Thus, each profoundly deaf student using the audible environment awareness restoring device can select whether to "listen" to his own voice or to his teacher's voice. Further, a profoundly deaf person first learning to use the audible environment restoring device can more easily distinguish between the feeling of the sound of his own voice and the feeling of the sound of the teacher's voice.

Obviously numerous modifications may be made to this invention without departing from its scope as defined in the appended claims.

I claim:

1. An audible environment awareness restoring device for allowing a person to feel an audible sound corresponding to a human voice, comprising:

a transducer for converting an electrical audio input signal into vibrations that vibrate in synchronism with the audio input signal;

a microphone for generating said electrical audio input signal;

a means for supporting said microphone;

a means for transmitting said electrical audio input signal generated by said microphone to said transducer; and a mounting means for positioning said transducer against a person's sternum so that said transducer lies flat against said sternum with enough pressure and with enough dampening to allow said vibrations from said transducer to be transmitted to said person's rib cage without interference from any movements from said person and to cause said rib cage to resonate in synchronism with said vibrations from said transducer, said mounting means comprising:

a retaining ring which holds said transducer and which has two holes on opposite sides of said retaining ring; and a clip which has a top, a back and two front arms on either side of said clip where said back extends downwardly from said top, where said two front arms extent downwardly from said top and parallel to said back, and where said two front arms have pivot rods that slip into said holes on said opposite sides of said retaining ring so that said retaining ring can rotate on said pivot rod ends and can better adjust itself to be able to lie flat against said person's sternum.

2. The audible environment awareness restoring device according to claim 1, wherein said transducer is an inertial transducer.

3. The audible environment awareness restoring device according to claim 2, wherein said inertial transducer vibrates in an audio frequency range of 4 Hz to 1000 Hz.

4. The audible environment awareness restoring device according to claim 1, wherein said microphone is omnidirectionally sensitive, and said supporting means positions said omnidirectionally sensitive microphone so that said electrical audio signal generated by said omnidirectionally sensitive microphone corresponds to an ambient audible environment.

5. The audible environment awareness restoring device according to claim 1, wherein said microphone is unidirectionally sensitive, and said supporting means positions said unidirectionally sensitive microphone in close proximity to said person's mouth so that said electrical audio input signal generated by said unidirectionally sensitive microphone corresponds to said person's own voice.

6. An audible environment awareness restoring device for allowing a person to feel an audible sound corresponding to a human voice, comprising:

a transducer for converting an electrical audio input signal into vibrations that vibrate in synchronism with the audio input signal;

a first microphone for generating said electrical audio input signal;

a first means for supporting said first microphone;

a first means for transmitting said electrical audio input signal generated by said first microphone to said transducer;

a second microphone for generating said electrical audio input signal;

a second means for supporting said second microphone;

a second means for transmitting said electrical audio input signal generated by said second microphone to said transducer; and a mounting means for positioning said transducer against a person's sternum so that said transducer lies flat against said sternum with enough pressure and with enough dampening to allow said vibrations from said transducer to be transmitted to said person's rib cage without interference from any movements from said person and to cause said rib cage to resonate in synchronism with said vibrations from said transducer, said mounting means comprising:

a retaining ring which holds said transducer and which has two holes on opposite sides of said retaining ring; and a clip which has a top, a back and two front arms on either side of said clip where said back extends downwardly from said top, where said two front arms extent downwardly from said top and parallel to said back, and where said two front arms have pivot rods that slip into said holes on said opposite sides of said retaining ring so that said retaining ring can rotate on said pivot rod ends and can better adjust itself to be able to lie flat against said person's sternum.

7. The audible environment awareness restoring device according to claim 6, wherein said transducer is an inertial transducer.

8. The audible environment awareness restoring device according to claim 7, wherein said inertial transducer vibrates in an audio frequency range of 4 Hz to 1000 Hz.

9. The audible environment awareness restoring device according to claim 6, wherein said first microphone is omnidirectionally sensitive, said first supporting means positions said first microphone so that said electrical audio input signal generated by said first microphone corresponds to an ambient environment, said second microphone is unidirectionally sensitive, and said second supporting means positions said second microphone in close proximity to said person's mouth so that s aid electrical audio input signal generated by said second microphone corresponds to said person's own voice.

10. An audible environment awareness restoring device for allowing a person to feel an audible sound corresponding to a human voice, comprising:

a transducer for converting an electrical audio input signal into vibrations that vibrate in synchronism with the audio input signal;

a microphone for generating said electrical audio input signal;

a means for supporting said microphone;

a secondary audio source for generating said electrical audio input signal;

a means for selectively transmitting one of said electrical audio input signals generated by said microphone and said secondary audio source to said transducer; and a mounting means for positioning said transducer against a person's sternum so that said transducer lies flat against said sternum with enough pressure and with enough dampening to allow said vibrations from said transducer to be transmitted to said person's rib cage without interference from any movements from said person and to cause said rib cage to resonate in synchronism with said vibrations from said transducer, said mounting means comprising:

a retaining ring which holds said transducer and which has two holes on opposite sides of said retaining ring; and a clip which has a top, a back and two front arms on either side of said clip where said back extends downwardly from said top, where said two front arms extent downwardly from said top and parallel to said back, and where said two front arms have pivot rods that slip into said holes on said opposite sides of said retaining ring so that said retaining ring can rotate on said pivot rod ends and can better adjust itself to be able to lie flat against said person's sternum.

11. The audible environment awareness restoring device according to claim 10, wherein said transducer is an inertial transducer.

12. The audible environment awareness restoring device according to claim 11, wherein said inertial transducer vibrates in an audio frequency range of 4 Hz to 1000 Hz.

13. The audible environment awareness restoring device according to claim 10, wherein said microphone is a high-sensitivity omnidirectional microphone, and said supporting means positions said microphone so that said electrical audio input signal generated by said microphone corresponds to an ambient audible environment and to said person's own voice.

* * * * *